US009067772B2

(12) United States Patent
Bouvier et al.

(10) Patent No.: US 9,067,772 B2
(45) Date of Patent: Jun. 30, 2015

(54) LAWNMOWER JACK DEVICE ASSISTED BY AN OUTBOARD MOUNTED CYLINDER

(75) Inventors: Patrice Bouvier, Vitre (FR); Remy Busson, Noyal sur Vilaine (FR)

(73) Assignee: France Hayon Developpement, Vitre (FR)

( * ) Notice: Subject to any disclaimer, the term of this patent is extended or adjusted under 35 U.S.C. 154(b) by 90 days.

(21) Appl. No.: 13/501,221

(22) PCT Filed: Apr. 6, 2010

(86) PCT No.: PCT/FR2010/050663

§ 371 (c)(1),
(2), (4) Date: Apr. 10, 2012

(87) PCT Pub. No.: WO2011/042629

PCT Pub. Date: Apr. 14, 2011

(65) Prior Publication Data

US 2012/0199801 A1 Aug. 9, 2012

(30) Foreign Application Priority Data

Oct. 10, 2009 (FR) ..... 09 04861

(51) Int. Cl.
*A62B 3/00* (2006.01)
*B66F 3/24* (2006.01)
(Continued)

(52) U.S. Cl.
CPC ... *B66F 7/22* (2013.01); *B66F 3/24* (2013.01); *B66F 3/247* (2013.01); *B66F 7/28* (2013.01)

(58) Field of Classification Search
USPC ..... 254/93 R, 131, 8 B, 88; 414/678, 672, 414/563
See application file for complete search history.

(56) References Cited

U.S. PATENT DOCUMENTS 1,424,186 A * 8/1922 Schuyler et al. ..... 187/403
2,274,619 A * 2/1942 Swan ..... 73/669
(Continued)

FOREIGN PATENT DOCUMENTS

FR 2873107 A1 1/2006
GB 668655 A 3/1952
WO 88/08378 A1 11/1988

OTHER PUBLICATIONS

International Preliminary Report on Patentability and English translation of the Written Opinion dated May 1, 2012, for corresponding International Application No. PCT/FR2010/050663, filed Apr. 6, 2010.
(Continued)

*Primary Examiner* — Lee D Wilson
*Assistant Examiner* — Alvin Grant
(74) *Attorney, Agent, or Firm* — David D. Brush; Westman, Champlin & Koehler, P.A.

(57) ABSTRACT

A lifting and/or tilting device is provided for a grass cutting machine, such as a ride-on mower. The device includes a fixed chassis element designed to rest on the ground. A movable chassis element is capable of accommodating at least one wheel of the machine and is movable about an axle supported by the fixed chassis element, between a stowed position, in which the movable chassis element extends essentially in the plane formed by the fixed chassis element, and at least one raised position in which the movable chassis element is separated from the fixed chassis element. The device has a cylinder with a body that is attached permanently to the fixed chassis element and a shaft that is movable relative to the body, attached permanently to the movable chassis element, and mounted in such manner that in the raised position it extends essentially outside of the zone delimited by the fixed and movable chassis elements.

18 Claims, 3 Drawing Sheets

(51) Int. Cl.

| | |
|---|---|
| ***E21D 15/44*** | (2006.01) |
| ***B66F 3/00*** | (2006.01) |
| ***B60P 1/48*** | (2006.01) |
| ***B66C 3/00*** | (2006.01) |
| ***H01L 21/687*** | (2006.01) |
| ***B66F 7/22*** | (2006.01) |
| ***B66F 7/28*** | (2006.01) |

(56) References Cited

U.S. PATENT DOCUMENTS

| | | | | | |
|---|---|---|---|---|---|
| 4,088,303 | A | * | 5/1978 | Aquila | 254/88 |
| 4,460,158 | A | * | 7/1984 | Chiesa et al. | 254/124 |
| 4,813,843 | A | * | 3/1989 | Gilmour et al. | 414/678 |
| 5,174,711 | A | * | 12/1992 | Binder et al. | 414/678 |
| 5,538,389 | A | | 7/1996 | Stone | |
| 5,678,804 | A | * | 10/1997 | Lintelman et al. | 254/131 |
| 5,775,870 | A | * | 7/1998 | Hogan | 414/678 |
| 5,826,857 | A | * | 10/1998 | Brack et al. | 254/8 R |
| 5,971,360 | A | * | 10/1999 | Sinsley | 254/8 B |
| 5,991,674 | A | * | 11/1999 | Froelich et al. | 701/36 |
| 6,003,432 | A | * | 12/1999 | Laulhe | 92/69 R |
| 6,039,505 | A | * | 3/2000 | Tenbusch, II | 405/156 |
| D431,707 | S | * | 10/2000 | Few | D34/31 |
| 6,336,783 | B1 | * | 1/2002 | Young et al. | 414/563 |
| 6,345,807 | B1 | | 2/2002 | Cacciatore | |
| 6,474,626 | B1 | * | 11/2002 | Box | 254/131 |
| 6,581,909 | B2 | * | 6/2003 | Wixey | 254/8 B |
| 6,588,983 | B1 | * | 7/2003 | Tenbusch, II | 405/184.3 |
| 6,948,724 | B2 | * | 9/2005 | Davis | 280/30 |
| 6,986,503 | B2 | * | 1/2006 | Arzouman | 254/8 B |
| 7,204,475 | B1 | * | 4/2007 | Burry et al. | 254/88 |
| 7,278,627 | B2 | * | 10/2007 | Jones | 254/88 |
| 8,684,332 | B2 | * | 4/2014 | Galla | 254/2 B |
| 2007/0266492 | A1 | * | 11/2007 | Junca | 4/661 |
| 2008/0069676 | A1 | * | 3/2008 | Kozak | 414/672 |
| 2010/0051884 | A1 | * | 3/2010 | Matthews et al. | 254/45 |
| 2011/0089389 | A1 | * | 4/2011 | Weber | 254/3 B |

OTHER PUBLICATIONS

International Search Report dated Jul. 9, 2012 for corresponding International Application No. PCT/FR2010/050663, filed Apr. 6, 2010.

* cited by examiner

LAWNMOWER JACK DEVICE ASSISTED BY AN OUTBOARD MOUNTED CYLINDER

CROSS-REFERENCE TO RELATED APPLICATIONS

This Application is a Section 371 National Stage Application of International Application No. PCT/FR2010/050663, filed Apr. 6, 2010, which is incorporated by reference in its entirety and published as WO 2011/042629 on Apr. 14, 2011, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the disclosure is that of machines for mowing lawns or any other grassy areas, and accessories therefor.

The disclosure relates more precisely to a device that enables a ride-on mower, a petrol-powered or an electric lawnmower, or any other similar machine to be lifted and/or tilted to one side or the other so that the cutter blades may be cleaned and/or the protective casing may be unclogged, maintenance activities may be carried out, and for example the blades may be sharpened or repairs carried out.

BACKGROUND OF THE DISCLOSURE

It is known to use a lifting mechanism to gain access to the underside of a lawnmower for purposes of cleaning or replacing the cutter blades.

These mechanisms most often have a tilting bearing structure that enables them to lift at least two wheels of the lawnmower. Two known types of tilting bearing structures are very widely used: structures with a single pivoting arm and parallelogram structures, constructed with two pivoting arms connected by a horizontal platform.

Thus for example, devices are known that are equipped with a lever, prolonged by a support arm, which is actuated and blocked in the raised position with the aid of an extension rod.

To raise the pivoting arm, it has also been suggested to use a jack formed by an endless screw that passes through a nut at the end of the arm and is operated by a crank or even a mechanical winch.

One drawback of these known devices is that they require physical strength to raise or tilt the lawnmower, particularly if the lawnmower is heavy. They are thus not suitable for use by those who are physically frail or weakened and/or if the lawnmower is heavy. More generally, they are awkward to use, and/or they are not of ergonomic design, which is unsatisfactory.

In order to limit the effort required on the part of the user, it has been suggested to use a cylinder to operate the device.

Document FR-A-2 873 107 describes such an example of the device, using a flexible cylinder or a piston rod cylinder which exerts a thrust under the pivoting arm of the chassis to cause it to tilt.

However, this device is associated with a number of disadvantages. It provides limited access to the underside of the lawnmower due to the presence of a cylinder. Moreover, a further disadvantage of this device consists in its residual vertical footprint after the pivoting arm has reached the limit stop against the body of the cylinder and has been lowered again.

A further disadvantage of this device is that it requires the use of specific cylinders, and for example a cylinder with a large rod or cylinder with a telescopic shaft.

Yet another disadvantage of this device is that it is possible for the user to cause the cylinder to retract inadvertently while working under the lawnmower, which is not acceptable from the point of view of safety.

SUMMARY

An exemplary embodiment of the present invention relates to a lifting and/or tilting device for a grass cutting machine, comprising a fixed chassis element designed to rest on the ground, and a movable chassis element that is capable of accommodating at least one wheel of the machine and is rotatable about an axle supported by the fixed chassis element, between a stowed position in which the movable chassis element extends essentially in the plane formed by the fixed chassis element, and at least one raised position in which the movable chassis element is separated from the fixed chassis element.

According to an embodiment of the invention, such a device comprises a cylinder having a body that is attached permanently to the fixed chassis element and a shaft that is movable relative to said body, attached permanently to the movable chassis element, and mounted in such manner that in the raised position it extends essentially outside of the zone delimited by the fixed and movable chassis elements.

Thus, in entirely novel manner an embodiment of the invention suggests the use of a cylinder to facilitate lifting the machine and/or tilting it to one side, which does not intrude in the space the user requires in order to work under the machine. Moreover, easy access is also provided to the cylinder control.

According to a particularly advantageous embodiment of the invention, the movable chassis element is configured such that in the retracted position it fits inside the fixed chassis element.

Accordingly, the device forms a compact assembly in the retracted position, which renders it very easy to store. In addition, the lower height of the chassis in the retracted position, also called the lower position, makes it easy to mount the wheels of the machine on the movable chassis.

According to a special feature of an embodiment of the invention, the axle is mounted essentially above the plane formed by the fixed chassis element.

In this way, a space is cleverly left free below the axle, and consequently essentially below the movable chassis element, in which the cylinder may be mounted in such manner that it pushes against the lower surface of the movable chassis element.

In at least one advantageous embodiment of the invention, the movable chassis element is a right-angled, "L"-shape, the angle of which is truncated.

In this way, it is possible to rest the chassis element flat on the ground.

The cylinder is preferably permanently attached to the fixed and the movable chassis elements at a point close to the axle.

Thus, a large lifting angle may be achieved, of 50° for example, when using an ordinary cylinder, and most importantly without the need to provide a cylinder with a telescopic rod.

According to an advantageous feature of an embodiment of the invention, such a device is equipped with at least one retractable jack that is permanently attached to the movable chassis element and braced against the fixed chassis element to lock the movable chassis element in at least one of the raised positions.

Thus, the user may work in completely safety, without any danger of an accident occurring due to the sudden lowering of the movable chassis element.

The movable chassis element advantageously includes a frame configured to accommodate one or more wheels, and a limit stop extending essentially perpendicularly to this frame.

The machine is thus restrained securely during lifting, thanks to the frame which forms a cradle for the wheels and the limit stop on which the lowest part of the machine may be rested. In addition, such a device is adapted, or at least may be adapted, to various machine sizes, with the aid of extensions for example.

The cylinder is preferably operated via a pedal or lever.

Thus the user does not have to bend down to operate the cylinder and he has one or both hands free to hold the machine if necessary.

According to an advantageous feature of an embodiment of the invention, the cylinder is of single-action design.

In this way, the cost of the device remains low.

In at least one special embodiment of the invention, the cylinder belongs to the group consisting of at least:

hydraulic cylinders;

pneumatic cylinders;

electric cylinders.

BRIEF DESCRIPTION OF THE DRAWINGS

Other characteristics and advantages of an embodiment of the invention will be more clearly evident upon reading the following description of an embodiment of the invention, provided purely for illustrative and non-limiting purposes, and of the accompanying drawings, in which.

DETAILED DESCRIPTION

As was explained in the preceding section, the principle of an embodiment of the invention is based primarily on the mounting of a lifting cylinder of the pivoting chassis element of a "lawnmower tilting" device outside of the area delimited by the fixed and movable chassis element of a "lawnmower tilting" device so as to obstruct the user as little as possible when he is working under the lawnmower.

Figure 1:
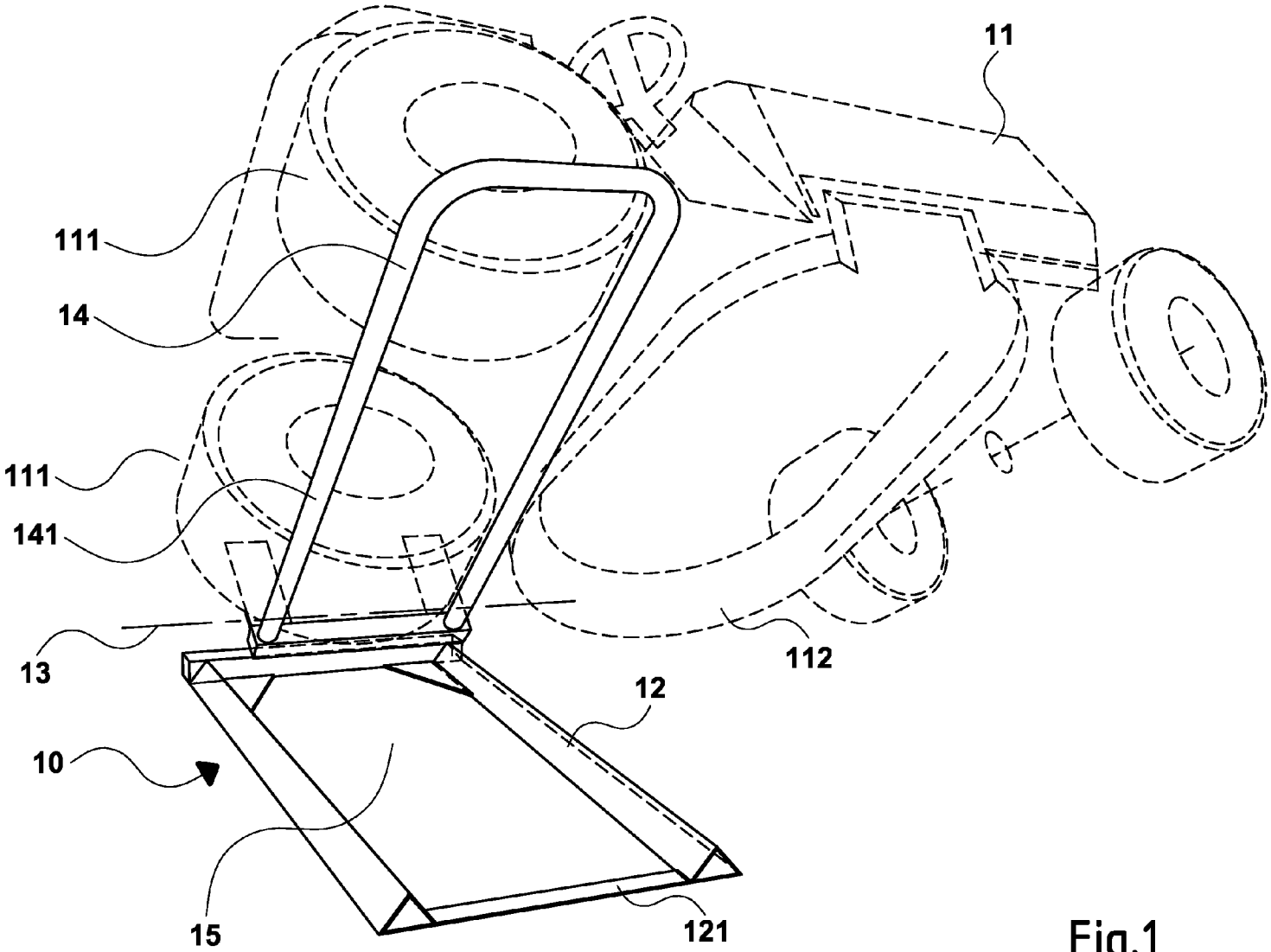
FIG. 1 is a diagrammatic, perspective view of an embodiment of a lifting and/or tilting device according to the invention in the raised position.

FIG. 1 shows a perspective view of an embodiment of a lifting and/or tilting device 10 according to the invention for a ride-on mower 11.

This device 10 comprises a fixed chassis element 12, resting on the ground and supporting an axle 13, which is elevated relative to the ground, for example by seventeen centimeters in this embodiment of the invention, and a movable chassis element 14 is articulated so as to be rotatable around said axle, said movable chassis element being shown in a raised position in FIG. 1.

As may be seen in FIG. 1, the rear wheels 111 of ride-on mower 11 rest on a portion of frame 141 of movable chassis element 14, and the mower is tilted to one side in this raised position. A user thus has broad access to the underside of the mower for purposes of cleaning the cutter blades and unclog cutter housing 112, for example.

In addition, it should be noted that no part of device 10 intrudes significantly in zone 15, which is delimited by fixed chassis element 12 and movable chassis element 14. This advantageous detail of an embodiment of the invention enables the user to lie down under the mower without difficulty, for example, to place his tools on the ground, to direct a hosepipe or the stream from a pressure washer at the underside of the lawnmower without any obstruction, and more generally to be able to move with complete freedom.

Figure 2:
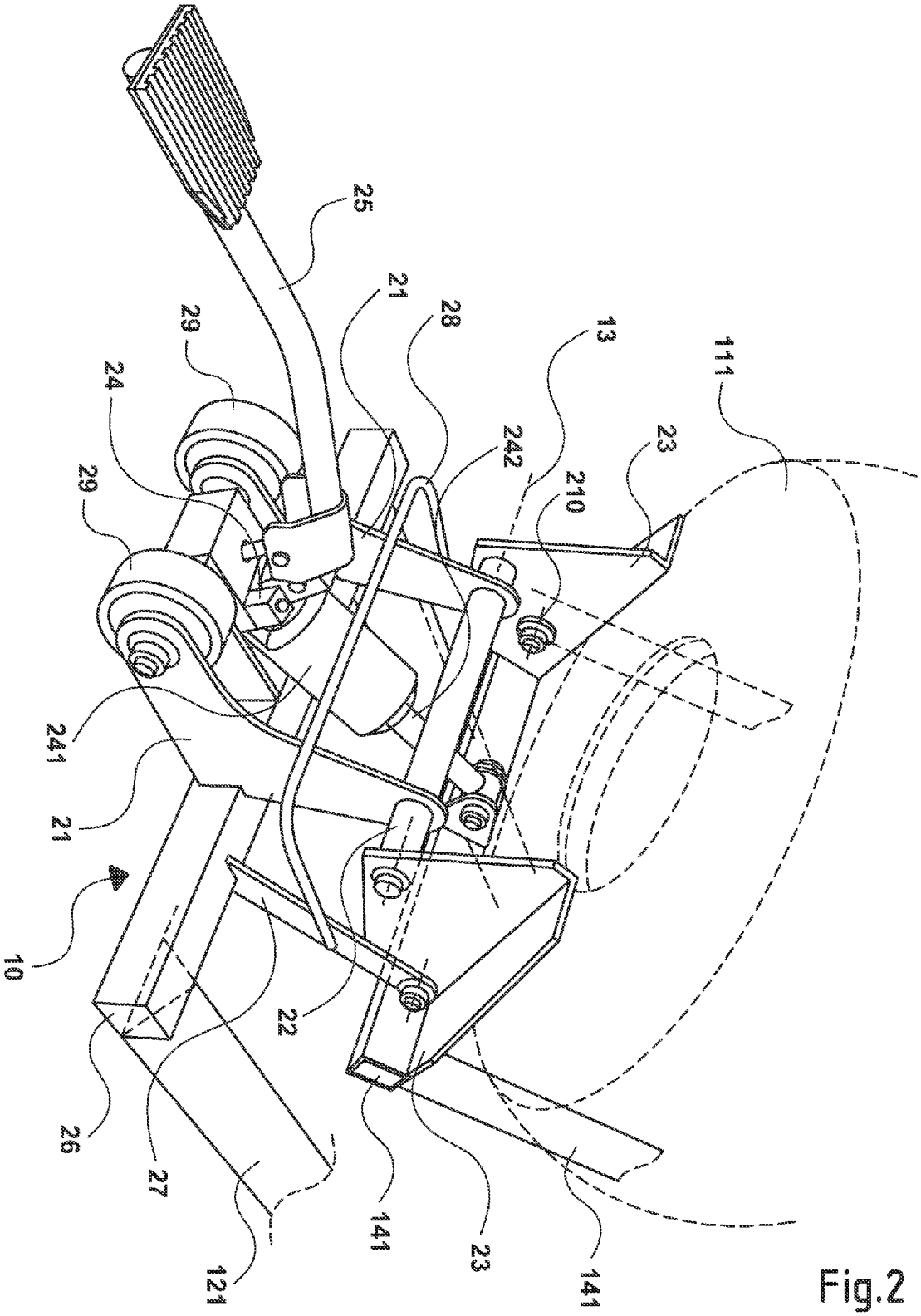
FIG. 2 is an enlarged view of the device of FIG. 1, from the rear.

In this embodiment of the invention, fixed chassis element 12 comprises a machine-welded metal frame 121 that defines a plane for element 12. This frame 121 is extended vertically by two legs 21 holding tubular bearing 22, in which axle 13 is housed, as is shown more clearly in the rear view of FIG. 2. It should be noted that frame 121 must be long enough to guarantee the stability of device 10.

Movable chassis element 14 is "L"-shaped. It is produced by welding or by any other known, suitable assembly method from a frame 141 that forms a cradle for the rear wheels of the lawnmower, with two metal angle members 23, which are positioned essentially perpendicularly to frame 141 and form a lateral limit stop that supports the lowest wheel.

The articulated attachment of movable chassis element 14 to fixed chassis element 12 is created by bolted the ends of axle 13 to angle members 23, which form a fork for axle 13.

In this embodiment of the invention, frame 141 has a tubular skeleton in order to avoid damaging the wheels when the lawnmower is rolled over it. The length of frame 141 has also been determined on the basis of the thickening of the rear wheels.

A single action cylinder 24 that is operable with the aid of a pedal 25 is mounted between fixed chassis element 12 and movable chassis element 14, passing below axle 13. The body 241 of this cylinder is permanently attached to the fixed chassis element in the area of axle 13, and the end of rod 242 of the piston in this cylinder is mounted so as to be pivotable about an axle 210 housed in a fork that extends away from frame 141. It is clearly evident from FIG. 2 that the rod of this cylinder exerts a thrust against the lower surface of movable chassis element 14, thus enabling it to be caused to pivot upwards or downwards simply by operating cylinder 24 (the effect of which is to cause rod 242 to be extended or retracted relative to cylinder body 241).

Figure 3:
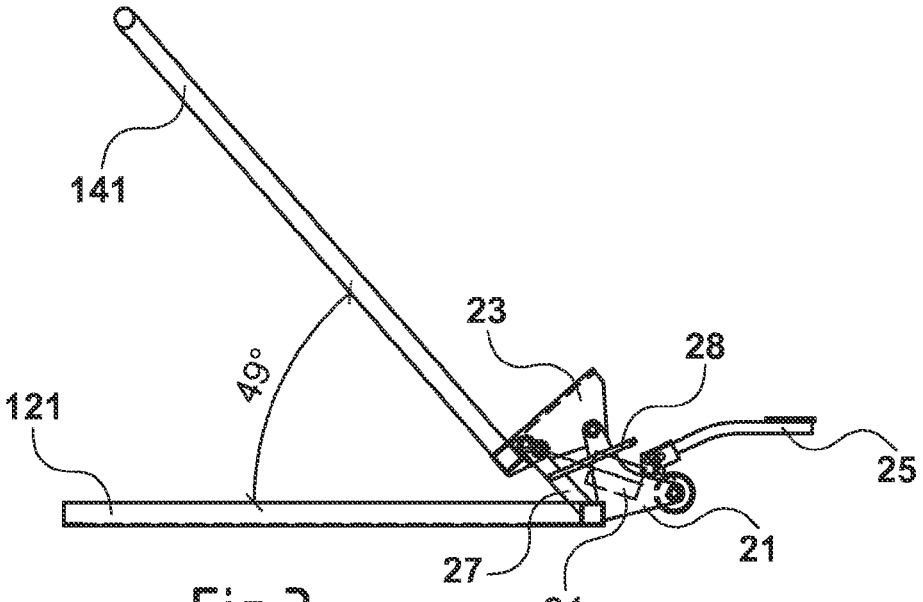
FIG. 3 is a side view of the device shown in FIG. 1.

Two lateral stands 27 have been provided to lock movable chassis element 14 in this fully raised position, in which frame 141 of movable chassis element 14 is separated from frame 121 by an angle of about 49° (see FIG. 3, which is a side view of device 10), and to prevent the frame from descending violently. A first extremity of these stands is mounted in pivoting manner on one or other of the angle members 23. The second end thereof is braced against rear crossmember 26 of frame 121, which serves as the locking arrangement. In this embodiment of the invention, this second extremity has the form of a bevelled recess that serves to strengthen the support on crossmember 121, which is provided by the square profile of the cross-section.

These stands are also connected via a safety arch that forms handle 28, with which jacks 27 may be retracted easily before starting to lower movable chassis element 14 from its fully raised position.

Rollers 29 have also been provided, mounted on fixed chassis element 12 to enable device 10 to be moved along the ground with ease.

Figure 4:
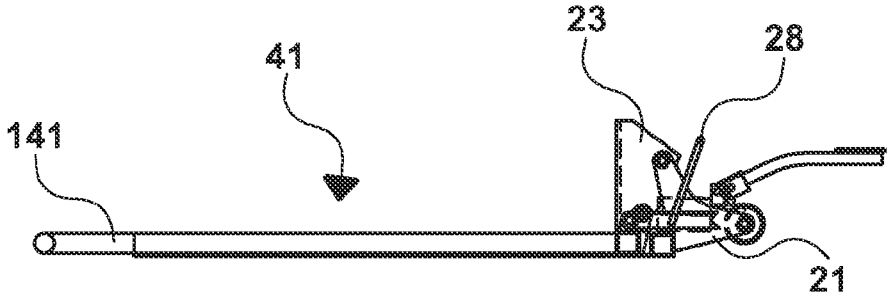
FIG. 4 shows a side view the device of FIG. 1 in the retracted position.
Figure 5:
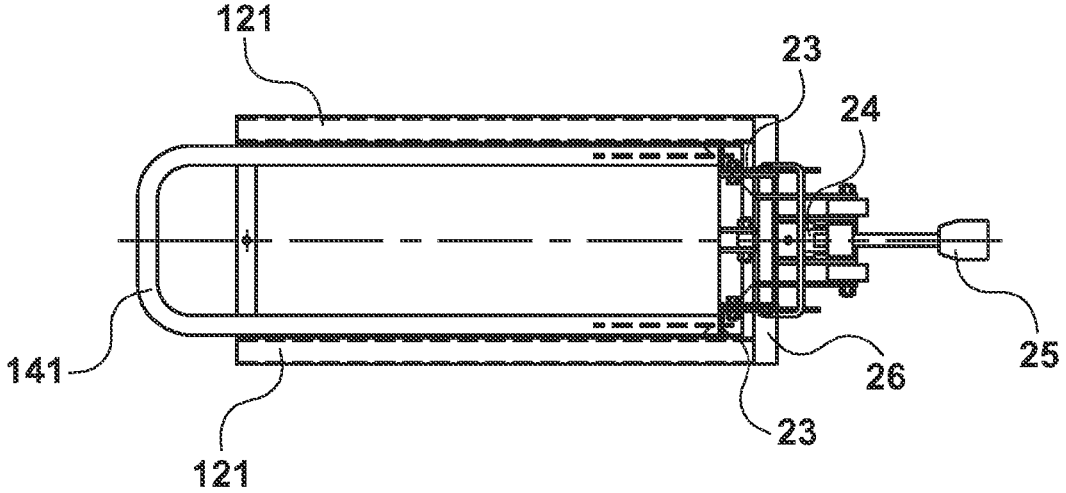
FIG. 5 is a top view of the device of FIG. 1 in the retracted position.

In FIGS. 4 and 5, device 10 is shown from the side in its retracted (lowered) position, after movable chassis element 14 has been tilted in the direction of arrow 41 to the level of the ground, which is effected by releasing the cylinder. It will be noted in the vertical cross section of FIG. 4 that the lower surface of frame 141 of the movable chassis element rests completely on the ground, its width allowing it to fit inside frame 121 of the fixed chassis element (see top view of the device in FIG. 5). Since frame 141 does not protrude above frame 121, device 10 thus presents an extremely compact, flat unit in the retracted position, which is valuable for purposes of storing the device and simplifies the operation of mounting the wheels of the machine on frame 141.

In variations of the embodiment of the invention described in detail in the preceding, it may also be provided:

- to equip the device according to an embodiment of the invention with a detachable stand, designed to be positioned between the fixed chassis element and the movable chassis element;
- if required, depending on the height of axle 13 relative to the ground and/or the thickness of the frame of the movable chassis element, to truncated the angle of the "L"-shaped movable chassis element to enable the frame thereof to be placed on the ground;
- to operate the cylinder by means of a lever;
- to use a hydraulic, pneumatic or electric cylinder.

In another variant, it is also conceivable without departing from the limits of the invention to modify the proportions and/or shapes of the lifting and/or tilting device as described in the preceding by means of simple structural measures, which will be readily and immediately apparent to one skilled in the art, in such manner that would enable it to be used to lift any ride-on lawnmower, and particularly an automotive vehicle, for example a motorcycle or a car. More generally, an embodiment of the invention may be adapted for use in lifting and/or tilting any heavy object.

In variations of the embodiments of the invention described in the preceding, it is also possible to conceive of a movable chassis element that would enable three or four wheels to be accommodated and/or to create an assembly for lifting the wheels of a ride-on lawnmower machine using two essentially identical lifting and/or tilting devices according to the invention, arranged level with the rear and front axles of the machine respectively, and connected via a rigid connecting rod.

An exemplary embodiment of the invention provides a device that offers effective lifting and/or tilting assistance.

An exemplary embodiment of the invention provides such a device that affords good access to the underside of the lawnmower.

An exemplary embodiment provides such a device that is simple to implement and relatively inexpensive to manufacture.

An exemplary embodiment also provides a device that is compact and easy to store.

An exemplary embodiment provides a device that is reliable, safe, and does not present a danger to the user.

The invention claimed is:

1. A tilting device for tilting a grass cutting machine to one side, comprising:

a fixed chassis element, designed to rest on the ground, which supports an axle;

a movable chassis element comprising an elongated frame having a longitudinal axis extending perpendicularly to the axle and configured to accommodate at least one wheel of the machine having an axis of rotation perpendicular to the axle of the fixed chassis element, wherein the movable chassis element is rotatable about the axle supported by the fixed chassis element, between a retracted position, in which the frame of the movable chassis element extends essentially in a plane formed by the fixed chassis element, and at least one raised position in which the frame of the movable chassis element is separated from the fixed chassis element, wherein the axle remains at a same location on the fixed chassis element when the movable chassis element is moved between the retracted position and the at least one raised position; and a cylinder in a vertical symmetry plane of the device along the longitudinal axis of the frame, and having a body that is attached permanently to the fixed chassis element and a shaft that is movable relative to said body, attached permanently to the frame, and mounted in such manner that in the raised position the shaft extends essentially outside of a zone delimited by the fixed and movable chassis elements.

2. The tilting device as recited in claim 1, wherein the movable chassis element is configured such that in the retracted position the movable chassis element fits inside the fixed chassis element.

3. The tilting device as recited in claim 2, wherein the axle is mounted essentially above the plane formed by the fixed chassis element.

4. The tilting device as recited in claim 3, wherein the movable chassis element is a right-angled, "L"-shape, the angle of which is truncated.

5. The tilting device as recited in claim 1, wherein the cylinder is permanently attached to the fixed and the movable chassis elements at a point close to the axle.

6. The tilting device as recited in claim 1, further equipped with at least one retractable jack that is permanently attached to the movable chassis element and braced against the fixed chassis element to lock the movable chassis element in at least one of the raised positions.

7. The tilting device as recited in claim 1, wherein the movable chassis element comprises a limit stop extending essentially perpendicularly to said frame.

8. The tilting device as recited in claim 1, wherein the cylinder is operated via a pedal or a lever.

9. The tilting device as recited in claim 1, wherein the cylinder is a single-action cylinder.

10. The tilting device as recited in claim 1, wherein the cylinder belongs to the group consisting of:

hydraulic cylinders;
pneumatic cylinders;
electric cylinders.

11. The tilting device as recited in claim 1, wherein the axle is mounted essentially above the plane formed by the fixed chassis element.

12. The tilting device as recited in claim 11, further equipped with at least one retractable jack that is permanently attached to the movable chassis element and braced against the fixed chassis element to lock the movable chassis element in at least one of the raised positions.

13. The tilting device as recited in claim 11, wherein the cylinder is a single-action cylinder.

14. The tilting device as recited in claim 12, wherein the movable chassis element comprises a limit stop extending essentially perpendicularly to said frame.

15. The tilting device as recited in claim 11, wherein the movable chassis element comprises a limit stop extending essentially perpendicularly to said frame.

16. The tilting device as recited in claim 1, wherein the movable chassis element comprises a limit stop extending essentially perpendicularly to said frame.

17. The tilting device as recited in claim 1, wherein the frame of the movable chassis element is rectangular and has a length and a width, wherein the length is greater than the width and extends perpendicularly to the axle.

18. The tilting device as recited in claim 1, wherein the frame comprises first and second spaced bars extending along the length and connected together by first and second cross bars, forming an open frame cradle arranged to support the at least one wheel between the first and second spaced bars with the axis of rotation being parallel to the bars.

* * * * *